US011198056B2

(12) United States Patent
Greenawalt et al.

(10) Patent No.: US 11,198,056 B2
(45) Date of Patent: Dec. 14, 2021

(54) MULTIPLE LEVEL JIGSAW PUZZLE

(71) Applicants: Thomas Greenawalt, Palm Harbor, FL (US); Jean Greenawalt, Palm Harbor, FL (US)

(72) Inventors: Thomas Greenawalt, Palm Harbor, FL (US); Jean Greenawalt, Palm Harbor, FL (US)

( * ) Notice: Subject to any disclaimer, the term of this patent is extended or adjusted under 35 U.S.C. 154(b) by 0 days.

(21) Appl. No.: 16/993,874

(22) Filed: Aug. 14, 2020

(65) Prior Publication Data

US 2021/0046379 A1 Feb. 18, 2021

Related U.S. Application Data

(63) Continuation of application No. 62/886,401, filed on Aug. 14, 2019.

(51) Int. Cl.
*A63F 9/12* (2006.01)

(52) U.S. Cl.
CPC ..... *A63F 9/1208* (2013.01)

(58) Field of Classification Search
CPC .. A63F 9/1208; A63F 9/10; A63F 9/12; A63F 2009/1083; A63F 2009/1088
See application file for complete search history.

(56) References Cited

U.S. PATENT DOCUMENTS 1,960,216 A * 5/1934 Schacht ..... A63F 9/10 273/157 R
1,964,007 A * 6/1934 Parks ..... A63F 9/12 273/157 R
3,558,136 A 1/1971 McFarland
3,682,479 A * 8/1972 Miller ..... A63F 9/12 273/157 R
T984,007 I4 * 7/1979 Richardson ..... A63F 9/10 156/220
4,257,606 A 3/1981 Launzel
4,259,804 A 4/1981 Samuels
4,469,331 A 9/1984 Rinker
4,534,563 A * 8/1985 Guenther ..... A63F 9/12 273/157 R
4,815,742 A 3/1989 Augustine
(Continued)

FOREIGN PATENT DOCUMENTS

DE 202017001674 U1 * 6/2017 ..... A63F 9/12
EP 1433506 A1 6/2004
(Continued)

OTHER PUBLICATIONS https://www.makeanything.design/3d-puzzles, last accessed May 17, 2019.

*Primary Examiner* — Steven B Wong
(74) *Attorney, Agent, or Firm* — Zagrebelsky Law P.A.; Robert Varkonyi

(57) ABSTRACT

A multiple level jigsaw puzzle comprised of varying thickness and irregular interlocking pieces which, when assembled, form an image with visible surfaces in relief relative to the tabular surface. The pieces have variable distinct surfaces and variable thickness with planar and/or textured surfaces to result in a raised relief 3D effect. The specific mix of individual pieces exhibiting variable thicknesses & distinct surfaces enhances enjoyment by adding strategic elements to puzzle assembly and optimizes the quality of the image.

18 Claims, 12 Drawing Sheets

(56) References Cited

U.S. PATENT DOCUMENTS

| | | | | | |
|---|---|---|---|---|---|
| 4,874,176 | A * | 10/1989 | Auerbach | A63F 9/1288 | 273/157 R |
| 5,178,391 | A | 1/1993 | Schoen | | |
| 5,306,006 | A * | 4/1994 | Bell | A63F 9/0098 | 273/156 |
| 5,362,054 | A | 11/1994 | Ashemimry | | |
| 5,441,262 | A | 8/1995 | Figone et al. | | |
| 5,806,853 | A * | 9/1998 | Druckman | A63F 9/12 | 273/156 |
| 6,012,718 | A | 1/2000 | McClellan | | |
| 6,427,926 | B1 | 8/2002 | Lai | | |
| 6,666,454 | B1 | 12/2003 | Cole et al. | | |
| 8,113,518 | B2 | 2/2012 | Rosen | | |
| 8,205,885 | B2 | 6/2012 | Latour et al. | | |
| 8,628,088 | B2 | 1/2014 | Sakdinan | | |
| 9,308,438 | B2 | 4/2016 | Yoshida | | |
| 2005/0179199 | A1* | 8/2005 | Gaussen | A63F 9/12 | 273/157 R |
| 2010/0109247 | A1* | 5/2010 | Cernansky | A63F 9/20 | 273/293 |

FOREIGN PATENT DOCUMENTS

| | | | | |
|---|---|---|---|---|
| GB | 419311 | A * | 11/1934 | A63F 9/1288 |
| GB | 1210452 | B1 | 10/1970 | |
| GB | 2196264 | B1 | 4/1988 | |

* cited by examiner

MULTIPLE LEVEL JIGSAW PUZZLE

CROSS REFERENCE TO RELATED APPLICATIONS

This application claims priority to U.S. Provisional Application 62/886,401, entitled: "Multiple Level Jigsaw Puzzle", filed Aug. 14, 2019, herein incorporated by reference in its entirety.

FIELD OF INVENTION

This invention relates to a jigsaw puzzle having different levels. Specifically, the invention provides jigsaw puzzles with multiple levels comprised of tiers designed to connect to the adjacent pieces using knobs and holes, whereby the multiple levels provide a new element in the strategic assembly of the jigsaw puzzle and enhance the impact of the three dimensional-like image.

BACKGROUND OF THE INVENTION

Jigsaw puzzles which are assembled by matching a number of interlocking puzzle pieces to form a two-dimensional pictorial illustration on the surface of the puzzle are well-known. Two-dimensional jigsaw puzzles are typically comprised of interlocking puzzle pieces which are one level thick and form a single level when the puzzle is assembled. Traditionally, puzzles were solved by sorting/grouping puzzle pieces by edge pieces, color or pattern, and piece shape (knobs & holes). Increasing the difficulty of these puzzles is accomplished by increasing the number of puzzle pieces. While this does increase the difficulty, it does not alter the strategy but solely increases the time necessary to complete the puzzle.

Solutions for making jigsaw puzzles more challenging and visually interesting are important to the consumer as jigsaw puzzles, and something new in the product line, are in great demand Two-dimensional jigsaw puzzles have many benefits including the improvement of problem solving/strategic thinking, short-term memory, visual & spatial reasoning, creativity, meditation & stress-relief, and learning ability. In addition, jigsaw puzzles can be designed to appeal to all ages, encourage social interaction or solitaire play. They also accommodate a wide range of difficulty levels that appeal to experts and those with special needs such as those on the autism spectrum or Dementia/Alzheimer's patients.

Three-dimensional images on jigsaw puzzles have created issues with the puzzle cost, deviations from familiar puzzle assembly and with the consistency and quality of the image. The image is either raised too drastically or not enough, not an image on a planar-based surface but a constructed object such as a building, or visually manipulated image (lenticular) on the piece thus negatively affecting the strategic assembly experience.

For example, Launzel (U.S. Pat. No. 4,257,606) provides for a jigsaw puzzle formed of puzzle pieces having varying height between a background section and object, with side shapes and surface contours to form an image elevated from the background. The assembled pieces generate an image having two levels. However, Launzel does not have adequate three-dimensional imagery, as the single elevation of the object does not provide for a well-defined projection of the object image. Furthermore, Launzel does not provide information about the breakdown of pieces into one-base level, one-elevated level, or two levels, and therefore does not provide information relating to the enhancement of the image and assembly strategy of the puzzle.

Rinker (U.S. Pat. No. 4,469,331) provides for a jigsaw puzzle formed on single level and multi-level pieces that are joined to preferably form up to three different levels. The puzzle pieces have knobs and notches or holes that are designed to fit pieces having the same height level, i.e. the third level notches/holes interact with the projections on third level of the neighboring piece. The upper levels of the puzzle are smaller than those of the lower levels, with the edges either contours, beveled, sloped, or having another shape. The puzzle pieces are designed such that lower levels must be assembled followed by higher levels, or levels assembled concurrently, as higher levels cannot be matched to lower levels. However, the puzzle is solved similarly to traditional puzzles, where each puzzle level must be solved independent of the others due to the height-specific jigsaw knobs and holes. Like Launzel, Rinker lacks information about the breakdown of pieces into one-base level, one-elevated level, or two levels, and therefore does not provide information relating to the enhancement of the image and assembly strategy of the puzzle.

As such, there is a need in the market for novel puzzles that alter and enhance the puzzle assembly strategy and quality of the three-dimensional image.

SUMMARY OF THE INVENTION

The inventive multiple level puzzle is formed of a plurality of single tier puzzle pieces, and at least one multiple tier puzzle piece. The three-dimensional, multiple level jigsaw puzzles of the present invention provide images with multiple raised sections while maintaining the classic jigsaw puzzle manufacturing processes. The strategy of assembling jigsaw puzzles is greatly dependent on the ability to sort and group the individual pieces. The typical order of sorting/grouping puzzle pieces is: border pieces, color or pattern, piece shapes (knobs & holes), and special or high contrast features. The inventive puzzle, with puzzle piece classifications, modifies the puzzle assembly strategy, due to height considerations and the breakdown of puzzle piece types by height, changes in tier elevation, number of separate levels and other factors. Thus, the multiple level jigsaw puzzles add new considerations to the sorting and grouping strategies. The inventive pieces can be sorted by thickness, changes in tier elevation, contoured relief surfaces, and the number of distinct surfaces. These multi-surface pieces are assembled to create the contoured edges using raised surfaces within the puzzle.

The plurality of single tier puzzle pieces includes at least a base tier, having a top face, a bottom face, and a minimum of three irregular edges disposed between the top face and the bottom face. A plurality of pieces optionally have four edges that generally forms a rectangle with a hole or knob on each edge. Irregular surfaces qualify as a knob or hole when they interlock with the complimentary hole or knob on an adjacent piece. The puzzle pieces have knobs and holes that interconnect for the entire thickness of the connecting puzzle pieces. Optionally, one or more elevated tiers are disposed on the top face of the base tier. The puzzle pieces include at least one knob or hole disposed on at least one irregular edge, wherein the knob or hole is complementary to an adjacent puzzle piece and interlocks with a complimentary hole or knob. Optionally, the base tier of the plurality of single tier puzzle pieces has a thickness of about 1.6 mm Non-limiting examples of the thicknesses include 1.5 mm, 1.55 mm, 1.6 mm, 1.65 mm, or 1.7 mm.

In some variations, the single level puzzle pieces include at least one contour textured surface disposed on the top face of the uppermost tier. The single level puzzle pieces optionally have one elevated tier, two elevated tiers, three elevated tiers, or four elevated tiers. The base tier thickness varies based on the number of additional tiers used in conjunction with the base tier, i.e. whether the puzzle has up to three tiers, up to four tiers, or up to five tiers, from 1.6 mm to 1.9 mm. In some variations, where the puzzle uses fewer total tier levels, the base tier is thicker. As non-limiting examples, a three-tier puzzle optionally has a base tier of 1.9 mm and a five-tier puzzle has a base tier of 1.6 mm. The elevated tiers have a thickness between 1.2 mm and 1.9 mm Where up to three elevated tiers are used, the elevated tier optionally has a thickness of about 1.6 mm to about 1.9 mm Non-limiting examples of the thicknesses include 1.5 mm, 1.55 mm, 1.6 mm, 1.65, 1.7 mm, 1.75 mm, 1.8 mm, 1.85 mm, 1.90 mm, 1.95 mm, and 2.0 mm Where four elevated tiers are used, each elevated tier has a thickness of about 1.2 mm Non-limiting examples of the thicknesses include 1.1 mm, 1.15 mm, 1.2 mm, 1.25 mm, and 1.3 mm.

The single level puzzle pieces have an optional overall thickness of between about 1.6 mm and about 6.4 mm Non-limiting examples of the thicknesses include 1.5 mm, 1.55 mm, 1.6 mm, 1.65 mm, 1.7 mm, or 1.75 mm, 1.8 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 31 mm, 3.2 mm, 3.3 mm, 3.4 mm, 3.5 mm, 36 mm, 3.7 mm, 3.8 mm, 3.9 mm, 4.0 mm, 4.1 mm, 4.2 mm, 4.3 mm, 4.4 mm, 45 mm, 4.6 mm, 4.7 mm, 4.8 mm, 49 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.1 mm, 6.2 mm, 6.25 mm, 6.3 mm, 6.35 mm, or 6.4 mm.

Single level puzzle pieces optionally include border pieces that frame the perimeter of the completed multiple level puzzle. Corner pieces have four irregular edges with a hole or knob on two of the edges that are complimentary and interlocking with adjacent pieces. Border edge pieces have four irregular edges with a hole or know on three of the edges that interlock with adjacent pieces.

The at least one multiple tier puzzle piece includes a base tier, wherein the base tier has a top face, a bottom face, and a minimum of three irregular edges disposed between the top face and the bottom face. At least a first elevated tier is disposed on the top face of the base tier, wherein the first elevated tier has a top face, a bottom face, and a minimum of three irregular edges disposed between the top face and the bottom face. The first elevated tier has a thickness, thereby forming a first height. In some variations, more than one elevated tier is disposed on the at least one multiple level puzzle piece. At least a second elevated tier is on the top face of the first elevated tier, and has a second tier top face, a second tier bottom face, at least one irregular edge disposed between the second tier top face and the second tier bottom face and correlating with one of the at least three irregular edges of the base tier. The second elevated tier has a thickness, thereby forming a second height. The elevated tiers optionally do not cover the entire tier below said tier. At least one knob or hole is disposed on one or more of the three irregular edges, wherein the knob or hole is complementary and interlocking to an adjacent puzzle piece.

Optionally, the multiple tier jigsaw puzzle pieces also include a variation having a base tier, a first elevated tier disposed on the top face of the base tier, a second elevated tier disposed on the first elevated tier, and a third elevated tier disposed on the second elevated tier. Further variations include puzzle pieces having a fourth elevated tier disposed on the third elevated tier. In these variations, the fourth elevated tier is a visible tier or is disposed under a fifth visible tier.

The base tier of the at least one multiple level puzzle piece varies based on the number of additional tiers used in conjunction with the base tier, as with the single tier puzzle piece. Thus, the base layer of the multiple tier puzzle piece optionally has a thickness of about 1.6 mm to 1.9 mm, which puzzles having higher numbers of tiers typically having thinner base layers. As non-limiting examples, a three-tier puzzle optionally has a base tier of 1.9 mm and a five-tier puzzle has a base tier of 1.6 mm. The elevated tiers have a thickness between 1.2 mm and 1.9 mm Where up to three elevated tiers are used, the elevated tier optionally has a thickness of about 1.6 mm to about 1.9 mm Nonlimiting examples of the base tier are similar to those thickness for the single tier puzzle piece. The at least one elevated tier has an optional thickness that varies based on the number of additional tiers used in the puzzle, and typically lies between about 1.2 mm to about 1.9 mm Where fewer tiers are used in manufacturing the puzzle, each tier is generally thicker. Therefore, a three tier puzzle can be expected to have a tier thickness of about 1.9 mm, whereas a five tier puzzle can be expected to have a tier thickness of 1.2 mm Non-limiting examples of the elevated tier thicknesses include 1.2 mm, 1.25 mm, 1.3 mm, 1.4 mm, 1.45 mm, and 1.5 mm, 1.55 mm, 1.6 mm, 1.6 mm, 1.7 mm, 1.75 mm, 1.8 mm, 1.85 mm, 1.9 mm, 1.95 mm, or 2.0 mm.

The multiple level jigsaw puzzle pieces optionally include a contoured textured surface disposed on the top face of the uppermost tier of the puzzle piece, designed to mimic a subject object.

The multiple tier jigsaw puzzle pieces optionally have one tier elevation change, two tier elevation changes, or three tier elevation changes. The puzzle pieces of the multiple level puzzle are optionally up to 3 tiers thick, 4 tiers thick, or 5 tiers thick. The elevation changes optionally include two separate elevations or three separate elevations. The multiple level puzzle pieces have an optional overall thickness of between about 1.6 mm and about 6.4 mm Non-limiting examples of the thicknesses include 1.5 mm, 1.55 mm, 1.6 mm, 1.65 mm, 1.7 mm, or 1.75 mm, 1.8 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.1 mm, 6.2 mm, 6.25 mm, 6.3 mm, 6.35 mm, or 6.4 mm.

Multiple level jigsaw puzzle pieces include border pieces that frame the perimeter of the completed multiple level puzzle. Corner pieces optionally have four irregular edges with a hole or knob on two of the edges that are complementary and interlocking with adjacent pieces. Border edge pieces optionally have four irregular edges with a hole or knob on three of the edges that interlock with adjacent pieces.

The inventive multiple level jigsaw puzzle pieces optionally have a larger average surface area than the standard jigsaw puzzle. The larger pieces allow for a greater number of pieces to have multiple levels while being tactilely and visually more appealing to a wider audience. In certain embodiments, the puzzle pieces further have an average surface area or average planar area of at least 1.0 square inches. Non-limiting examples include 1.0 sq·in., 1.10 sq·in., 1.15 sq·in., 1.20 sq·in., 1.25 sq·in., 1.30 sq·in., 1.35 sq·in., 1.40 sq·in., 1.45 sq·in., 1.50 sq·in., 1.55 sq·in., 1.60 sq·in., 1.65 sq·in., 1.70 sq·in., 1.75 sq·in., 1.80 sq·in., 1.85 sq·in., 1.90 sq·in., 1.95 sq·in., 2.00 sq·in., 2.05 sq·in., 2.10 sq·in., 2.15 sq·in., 2.2 sq·in., 2.25 sq·in., 2.3 sq·in., 2.4 sq·in., 2.5 sq·in., 2.6 sq·in., 2.7 sq·in., 2.8 sq·in., 2.9 sq·in., 3.0 sq·in., 3.1 sq·in., 3.15 sq·in., 3.2 sq·in., or 3.25 sq·in. The puzzle pieces of the multiple level puzzle are optionally made of cardboard, wood, paperboard, chipboard, or plastic. Optional plastics include high impact polystyrene, acrylonitrile butadiene styrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile.

The puzzle pieces of the multiple level jigsaw puzzle can be classified in various ways. The classifications enable the optimization of both the image quality and the enjoyment of the puzzle assembly. A first classification is based on the number of visible surface tiers disposed on the puzzle piece. For example, the single level puzzle pieces can be identified as single level but multiple tier pieces. The single level pieces can be further identified as visible tier 1 pieces, visible tier 2 pieces, visible tier 3 pieces, or visible tier 4 pieces. Multiple level pieces have two or three visible tiers. For example, a puzzle piece with tier 2 and tier 3 visible top surfaces is identified as a visible tier 2 and a visible tier 3. The puzzle pieces are optionally formed such that at least 35% of the puzzle pieces are fall into a visible tier 1 classification, at least 15% fall into a visible tier 2 classification, at least 15% fall into a visible tier 3 classification, and at least 15% fall into a visible tier 4 classification. For example, without being limited in scope, the visible tier 1 puzzle pieces can comprise 35%, 36%, 37%, 38%, 39%, 40%, 41%, 42%, 43%, 44%, 44.5%, 45%, 47.5%, or 50%. Similarly, visible tier 2 optionally comprise, without limiting the scope of the invention, 15%, 16%, 17%, 18%, 19%, 20%, 21%, 22%, 22.5%, 25%, 27.5%, or 30%. Visible tier 3 can comprise, without being limited in scope, 15%, 15.5%, 16%, 16.5%, 17%, 17.5%, 18%, 19%, 20%, 21%, 22%, 23%, 24%, 25%, 26%, 27%, 27.5%, or 30%. Visible tier 4 can comprise, without being limited in scope, 15%, 17.5%, 20%, 22.5%, 23%, 24%, 25%, 26%, 27%, 28%, 29%, 30%. 31%, 32%, 32.5%, 33%, 34%, 35%, 36%, 37%, 38%, 39%, or 40%.

The second classification of puzzle pieces is by piece type. The piece type classification includes flat or one level pieces, bi-level pieces, and tri-level pieces. For example, a bi-level piece may include a tier 1 and a tier 3 on the same piece and is identified as a 1+3 puzzle piece. Similarly, a tri-level piece may have a tier 1, a tier 3 and a tier 4 on the same piece and is identified as a 1+3+4 puzzle piece. Optionally, the flat pieces (one level or single level pieces) in the piece type classification can comprise at least 20% of the puzzle pieces. Nonlimiting examples include 20%, 21%, 22%, 24%, 25%, 26%, 27% 28%, 29%, 30%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 57.5%, 60%, or 65%. The bi-level pieces optionally comprise at least 35% of the puzzle pieces. Nonlimiting examples include 35%, 36%, 37%, 38%, 39%, 40%, 41%, 42%, 43%, 44%, 45%, 46%, 47%, 48%, 49%, 50%, 51%, 52%, 53%, 54%, 55%, 57.5%, 60%, or 65%. The tri-level pieces optionally comprise at least 5% of the puzzle pieces. Nonlimiting examples include 5%, 6%, 7%, 8%, 9%, 10%, 11%, 12%, 13%, 14%, 15%, 16%, 20%, 25%, 30%, or 35%.

A third classification of the jigsaw puzzle pieces is by the change in tier elevation disposed on the multiple level puzzle pieces. For example, the puzzle pieces can be identified as having no change in tier elevation. In some variations, the puzzle pieces that do not change tier elevation comprise at least 35% of the puzzle pieces. Non-limiting examples include 35%, 37%, 40%, 42.5%, 45%, 47.5%, 50%, 52.5%, or 55%. Variations of the invention include puzzle pieces having one tier elevation change, and optionally comprise at least 25% of the puzzle pieces. Non-limiting examples include 25%, 26%, 27%, 28%, 29%, 30%, 35%, 37%, 40%, or 45%. The puzzle pieces can also include a two-tier elevation change that comprise at least 12% of the puzzle pieces. Non-limiting examples include 12%, 13%, 14%, 15%, 16%, 17%, 18%, 19%, 20%, 21%, 22%, 23%, 24%, 25%, 26%, 27%, 28%, 29%, 30%, 31%, 32%, or 33%. The puzzle pieces can include a three-tier elevation change, that comprise at least 8% of the puzzle pieces. Non-limiting examples include 8%, 9%, 10%, 11%, 12%, 13%, 14%, 15%, 16%, 17%, 18%, 19%, 20%, 22.5%, or 25%.

Puzzle pieces may be identified as part of more than one classification. For example, multiple level piece 1+3+4 is identified in all 3 classifications. In the classification for visible tiers, it has a visible tier 1, a visible tier 3, and a visible tier 4. In the classification for piece part, it has one tri-level. And in the classification for change in tier elevation, it has a one tier elevation change, a two tier elevation change, and a three tier elevation change.

The inventive multiple level jigsaw puzzle has border pieces that may have straight edge, jigsaw edge, or contoured edge. The border pieces are optionally comprised of a corner piece with two border edges and a knob or hoe on each of the two non-border edges, and side pieces with one border edge and a knob or hole on the three non-border edges.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The inventive multiple level jigsaw puzzle is designed to enhance the image and alter the strategy and assembly used in completing jigsaw puzzles. The pieces include single level pieces and multiple level puzzle pieces. The puzzle pieces include at least a base tier, and optionally one or more elevated tiers are disposed on the base tier. The multiple level puzzle pieces optionally have one elevated tier, two elevated tiers, three elevated tiers, or four elevated tiers, and can include one elevation change, two elevation changes, or three elevation changes. The puzzle pieces of the multiple level puzzle are optionally up to 3 tiers thick, 4 tiers thick, or 5 tiers thick. The tier elevation changes optionally include two separate visible tiers or three separate visible tiers. The multiple level puzzle optionally includes a contoured texture disposed on the top face of the puzzle pieces, designed to mimics a subject object.

As used herein, the singular forms "a," "an" and "the" include plural referents unless the context clearly dictates otherwise. Thus, for example, reference to "an insert" includes a single element or two or more elements.

As used herein, "about" means approximately or nearly and in the context of a numerical value or range set forth means ±15% of the numerical.

As used herein, "adjacent" means a section of the puzzle in proximity to the puzzle piece when the puzzle is assembled.

Figure 1:
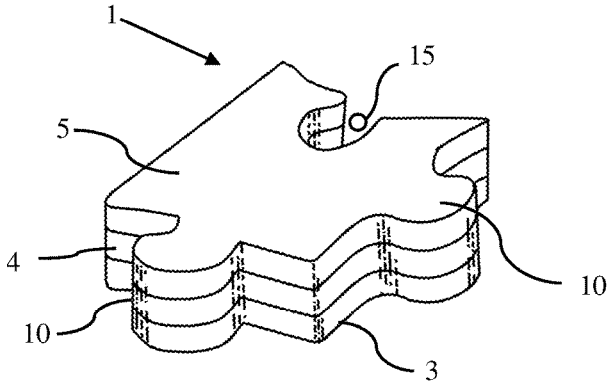
FIG. 1 is an isometric view of a single level jigsaw puzzle piece showing multiple tiers in an embodiment of the invention.

As used herein, "top" or "upper" and "lower" or "bottom" are referenced on the image depicted in FIG. 1. "Top" or "upper" means any portion of the puzzle directed to the top in FIG. 1. For example, reference number 5 is above reference number 3. "Lower" or "bottom" is directed toward the bottom of FIG. 1.

As used herein, "complementary" means geometrically shaped and sized elements that conform to the adjacent element, such that a male element conforms to a female part to which it is being interconnected, or a female element conforms to a male element.

As used herein, "interlocking" means the respective pieces are united firmly together due to adjacent elements having complementary contours of recesses and projections.

As used herein, "visible" means the top face of the tier element is capable of being seen.

As used herein, "knob" means a protrusion extending from the edge of a puzzle piece. In some instances, the knob is rounded, though a protrusion is not required to be rounded to meet the definition herein.

As used herein, "hole" means a gap or opening along the edge of a puzzle piece, i.e. a section of the puzzle recessing in from the edge of the puzzle piece.

As used herein, "thickness" means the distance between the top face and the bottom face of a tier or puzzle piece.

As used herein, "tier" means one of a number of successively overlapping layers or rows placed one above the other to from multiple tiers. For a single tier puzzle piece, the puzzle piece may have overlapping tiers or may be formed on a single, base tier having no overlapping layers or rows. The tiers include the full row or a subset thereof. For example, where a tier is 1.6 mm thick, the tier can vary in thickness to accommodate a texture on the tier. In some examples, without being limited in scope, the 1.6 mm thick tier can vary from about 0.8 mm to 2.0 mm, accommodating a contoured texture that approximates the three-dimensional elements of an image, such as those depicted in FIGS. 15 and 16.

Ranges disclosed herein include subsets of the specified ranges.

Example 1

Figure 2:
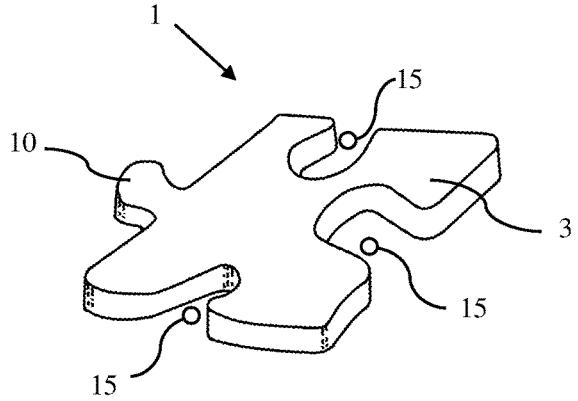
FIG. 2 is an isometric view of a single level jigsaw puzzle piece in an embodiment of the invention, showing a base tier puzzle piece.

The multiple level jigsaw puzzle is formed of a plurality of single tier puzzle pieces and at least one multiple tier puzzle pieces, designed to enhance and alter the puzzle's image and assembly strategy. The puzzle pieces include single tier puzzle piece 1 and multiple tier puzzle piece 2. Single tier puzzle piece 1 can be a puzzle piece having a single level, multiple-tier elevation, as seen in FIG. 1. The single level multi-tiered puzzle piece includes base tier 3 and at least one elevated tier. In FIG. 1, the single level, multi-tiered puzzle piece includes base tier 3, first elevated tier 4, and second elevated tier 5. However, other elevated puzzle pieces are formed of base tier 3 and first elevated tier 4, base tier 3 with first elevated tier 4 and second elevated tier 5 and third elevated tier 6. The single level puzzle pieces can be formed of only base tier 3, as seen in FIG. 2. Knob 10 is positioned on one or more tiers and dimensioned to engage, or interlock with, hole 15 on an adjacent piece, thereby locking the two adjacent puzzle pieces together. Hole 15 is similarly positioned on one or more tiers to engage knob 10 of an adjacent puzzle piece. The puzzle pieces may include any combination of knobs and holes along the edges of the piece. Further, the puzzle pieces include along the irregular edges of the piece, which are complementary to the geometry on an adjacent puzzle piece.

Figure 3:
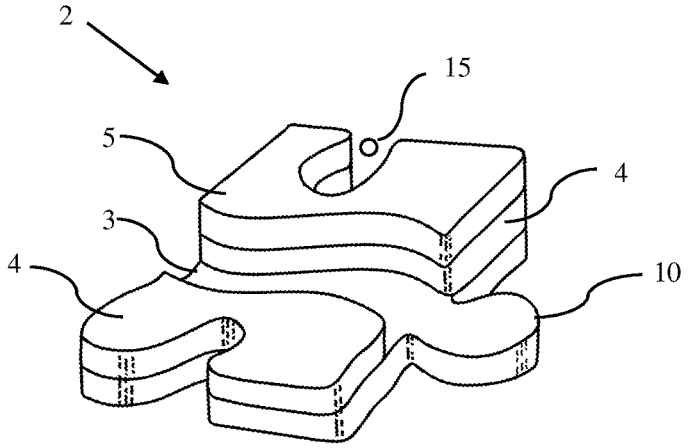
FIG. 3 is an isometric view of a multiple level jigsaw puzzle piece having multiple changes in tier elevations and three visible tiers, in an embodiment of the invention.
Figure 4:
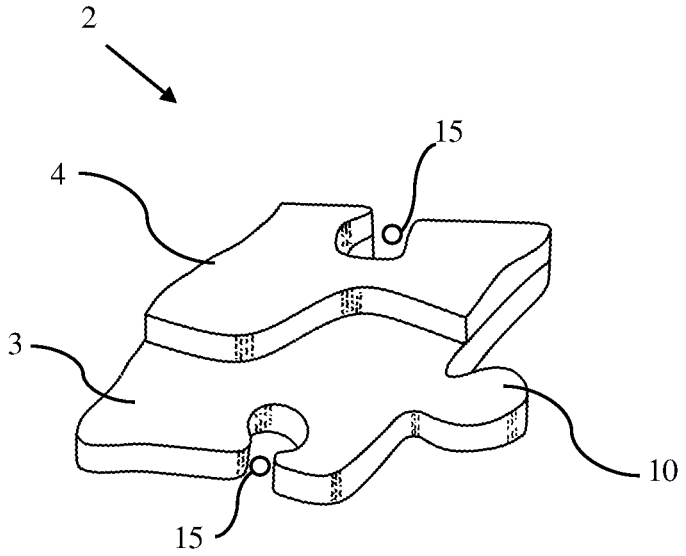
FIG. 4 is an isometric view of a multiple level jigsaw puzzle piece having one change in tier elevation, and two visible tiers in an embodiment of the invention.
Figure 5:
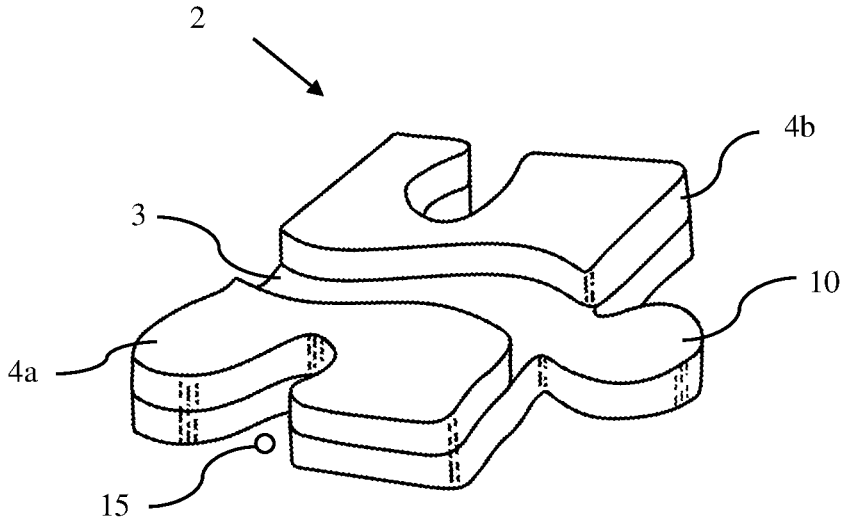
FIG. 5 is an isometric view of a multilevel jigsaw puzzle piece having three visible tiers and two changes in tier elevation, in an embodiment of the invention.

Multiple tier puzzle piece 2 can be formed having two or more different visible tiers on the same piece, as seen in FIGS. 3 through 5. Multiple tier puzzle piece 2 optionally has numerous changes in elevation, as seen in FIG. 3, where the elevation difference is one tier between the base tier and a first elevated tier, one tier between the first elevated tier and the second elevated tier, and two tiers between the base tier and a second elevated tier. In the exemplary figure of the puzzle piece, the piece is formed of base tier 3 and two separate sections or visible tiers, one forming first elevated tier 4 and the other being a second elevated tier 5. Other embodiments of multiple tier puzzle piece 2 possess one change in elevation, as seen in FIG. 4, where the elevation difference is one tier. In the figure, the piece is formed of base tier 3 and a first elevated tier 4 having a smaller area than base tier 3. Alternatively, the multiple tier puzzle piece is formed of base tier 3 with a first elevated tier 4*a* having a smaller area than base tier 3 and a second elevated tier 4*b* having a smaller area than base tier 3, as seen in FIG. 5.

Example 2

The multiple level jigsaw puzzle is formed of a plurality of single tier puzzle pieces and multiple tier puzzle pieces, designed to enhance and alter the puzzle's image and assembly strategy. The puzzle pieces include single tier puzzle piece 1 and multiple tier puzzle piece 2. Single tier puzzle piece 1 can be a puzzle piece having a single level, multiple-tier elevation, as described in Example 1.

Figure 6:
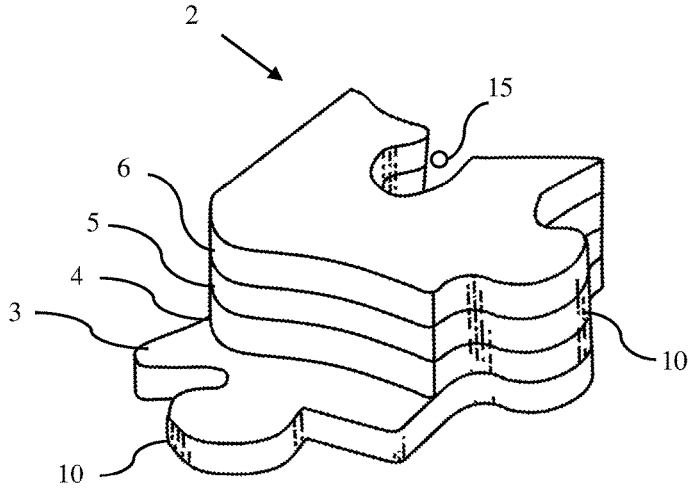
FIG. 6 is an isometric view of a multilevel jigsaw puzzle piece having three changes in tier elevation and two visible tiers, in an embodiment of the invention.

Multiple tier puzzle piece 2 can be formed having two or more different visible tiers on the same piece. For example, multiple tier puzzle piece 2 can include visible sections of tier 1, 2, 3, the visible tier 4, in any combination. In the illustrative drawing, multilevel puzzle piece 2 has a change in elevation covering multiple tiers, from tier 4 to tier 1, as seen in FIG. 6. Multilevel puzzle piece 2 includes variations disclosed in Example 1, as well as variations having base tier 3, first elevated tier 4, second elevated tier 5, and third elevated tier 6, where the elevated tiers have a smaller area than base tier 3. In the figure, all the elevated tiers have the same surface area, such that the change in elevation from the elevated tier to the base tier is three tiers. In other embodiments, the change in tier elevation from a higher tier to a base tier or lower tier is one tier, two tiers, or three tiers. Knob 10 is disposed on base tier 3, with a second knob 10 disposed on base tier 3, first elevated tier 4, second elevated tier 5, and third elevated tier 6. The knobs are each dimensioned to engage, or interlock with, a respective hole 15 on an adjacent piece, thereby locking two adjacent puzzle pieces together. Hole 15 is disposed in base tier 3, first elevated tier 4, second elevated tier 5, and third elevated tier 6 and dimensioned to accept a knob from an adjacent puzzle piece. Further, the puzzle pieces include along the irregular edges of the piece, which are complementary to the geometry on an adjacent puzzle piece.

Figure 7:
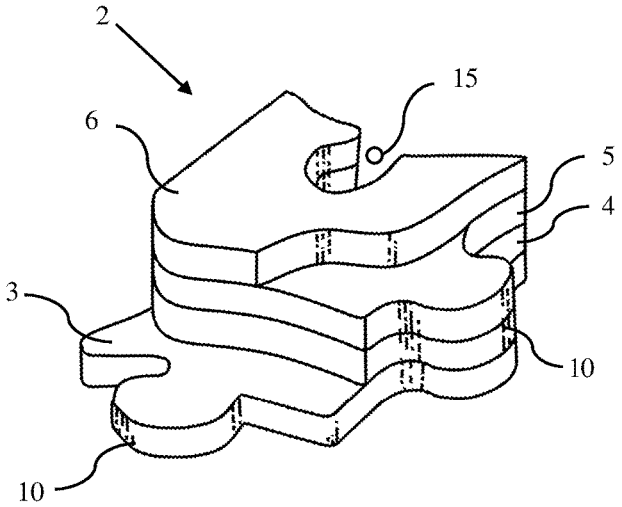
FIG. 7 is an isometric view of a multilevel jigsaw puzzle piece having multiple changes in tier elevations and three visible tiers, in an embodiment of the invention.

In other variations of the multiple tier puzzle piece, the puzzle piece has two drops in elevation, as seen in FIG. 7. An example for this variation shows multiple tier puzzle piece 2 with exposed, or visible, sections of tier 1, 3, and 4. Multilevel puzzle piece 2 includes base tier 3, first elevated tier 4, second elevated tier 5, and third elevated tier 6, where first elevated tier 4 and second elevated tier 5 have a smaller area than base tier 3, but first elevated tier 4 and second elevated tier 5 share the same area, i.e. are the same size. Third elevated tier 6 has a smaller area than first elevated tier 4 and second elevated tier 5, resulting in the puzzle piece having three exposed tiers.

Figure 8:
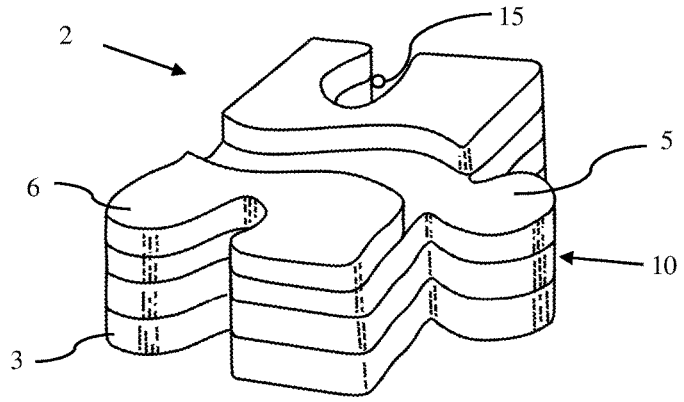
FIG. 8 is an isometric view of a multilevel jigsaw puzzle piece having multiple changes in tier elevations and two visible tiers, in an embodiment of the invention.
Figure 9:
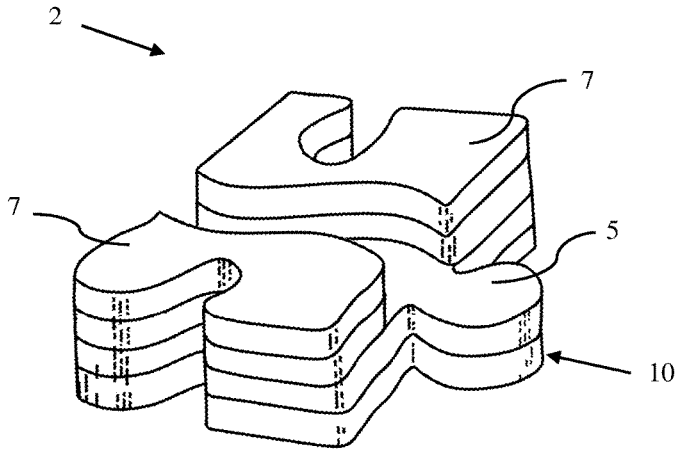
FIG. 9 is an isometric view of a multilevel jigsaw puzzle piece having multiple changes in tier elevation and three visible tiers, in an embodiment of the invention.

In other variations of the multiple tier puzzle piece, the puzzle piece has one drops in elevation but two changes in elevation, as seen in FIG. 8. An example for this variation shows multiple tier puzzle piece 2 with exposed, or visible, sections of tier 2 and 4. Multilevel puzzle piece 2 includes base tier 3, first elevated tier 4, second elevated tier 5, and third elevated tier 6, where first elevated tier 4 has a smaller area than base tier 3. but first elevated tier 4 has a larger area than second elevated tier 5. Second elevated tier 5 and third elevated tier 6 share the same area, i.e. are the same size, and split into two separate sections, such that third elevated tier 6 covers second elevated tier 5, resulting in the puzzle piece having two exposed tiers and two changes in elevation. In a similar variation, the multiple tier puzzle piece optionally includes a two-tier change in elevation, from third elevated tier 6 to first elevated tier 4 and back to third elevated tier 6, as seen in FIG. 9.

Thus, the puzzle piece types include flat or single-level pieces, bi-level pieces having two different elevations, tri-level pieces having three different elevations. Subsets of these puzzle pieces can include two changes in tier elevation from a first tier elevation to a second tier elevation and back to the first tier elevation.

Example 3

The multiple level jigsaw puzzle is formed of a plurality of single tier puzzle pieces and multiple tier puzzle pieces, designed to enhance and alter the puzzle's image and assembly strategy. The puzzle pieces include single tier puzzle piece 1 and multiple tier puzzle piece 2. Single tier puzzle piece 1 can be a puzzle piece having a single level, multiple-tier elevation, as described in Example 1.

Figure 10:
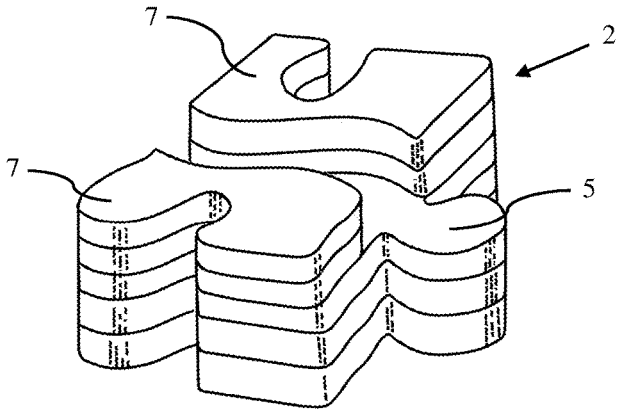
FIG. 10 is an isometric view of a multilevel jigsaw puzzle piece having multiple changes in tier elevation and two visible tiers, in an embodiment of the invention.

Multiple tier puzzle piece 2 can be formed having two or more different visible tiers on the same piece. For example, multiple tier puzzle piece 2 can include visible sections of tier 1, 2, 3, 4, or top-most tier 5, in any combination, except that the top-most tier must be exposed. The multiple tier puzzle pieces include variations disclosed in Examples 1 and/or 2, as well as variations having four elevated tiers. The latter examples include base tier 3, first elevated tier 4, second elevated tier 5, and third elevated tier 6, and fourth elevated tier 7, as seen in FIG. 10. Multiple tier puzzle piece 2 optionally has numerous changes in elevation, where the elevation difference is one or more tiers in distance. Further, the elevation change can occur between the base tier and a first elevated tier, one tier between the first elevated tier and the second elevated tier; two tier change between the base tier and the second elevated tier, between the first elevated tier and the third elevated tier, or between the second elevated tier and the fourth elevated tier; three tier change between the base tier and the third elevated tier, or the first elevated tier and the fourth elevated tier; or a four tier change between the base tier and fourth elevated tier.

In the exemplary figure of the puzzle piece, the piece is formed of base tier 3 with two separate visible tiers, between second elevated tier 5 and fourth elevated tier 7. Multiple tier puzzle piece 2 possess one change in elevation, in two locations, where the elevation difference is multiple tiers. In the figure, the piece is formed of base tier 3, and first elevated tier 4 and second elevated tier 5 having the same area as base tier 3, i.e. the base tier and first and second elevated tier are the same size and shape. Third elevated tier 6, and fourth elevated tier 7 are smaller in area than first elevated tier 4, resulting in a visible section of second elevated tier 5 and a visible section of fourth elevated tier 7. This also results in a change in elevation from the second elevated tier to the fourth elevated tier, or a two-tier elevation change.

Figure 11:
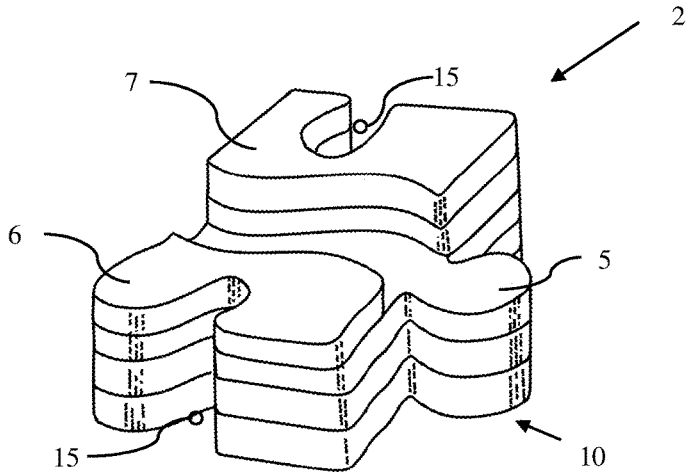
FIG. 11 is an isometric view of a multilevel jigsaw puzzle piece having multiple changes in tier elevations and three visible tiers, in an embodiment of the invention.

Other embodiments of multiple tier puzzle piece 2 possess multiple changes in elevation, as seen in FIG. 11, where the elevation difference is multiple tiers. In the figure, the piece is formed of base tier 3, first elevated tier 4 and second elevated tier 5 having the same area as base tier 3, i.e. the base tier and first and second elevated tier are the same size and shape. Third elevated tier 6 is smaller than second elevated tier 5 and fourth elevated tier 7 smaller in area than third elevated tier 6, resulting in a visible section of second elevated tier 5, third elevated tier 6 and a visible section of fourth elevated tier 7. This also results in two changes in elevation from the second elevated tier to the third elevated tier and to the fourth elevated tier. Further, in the illustrative example, the puzzle piece includes a one-tier elevation change, i.e. from the second elevated tier to the third elevated tier, and a two-tier elevation change, i.e. from the second elevated tier to the fourth elevated tier. Furthermore, in the illustrative embodiment, knob 10 extends from base tier 3, first elevated tier 4, and second elevated tier 5. The puzzle piece also includes two holes 15, found disposed within base tier 3, first elevated tier 4, second elevated tier 5, and third elevated tier 6, and fourth elevated tier 7. Knob 10 is dimensioned to engage, or interlock with, hole 15 on an adjacent piece, thereby locking the two adjacent puzzle pieces together. Further, the puzzle pieces include along the irregular edges of the piece, which are complementary to the geometry on an adjacent puzzle piece.

Figure 12:
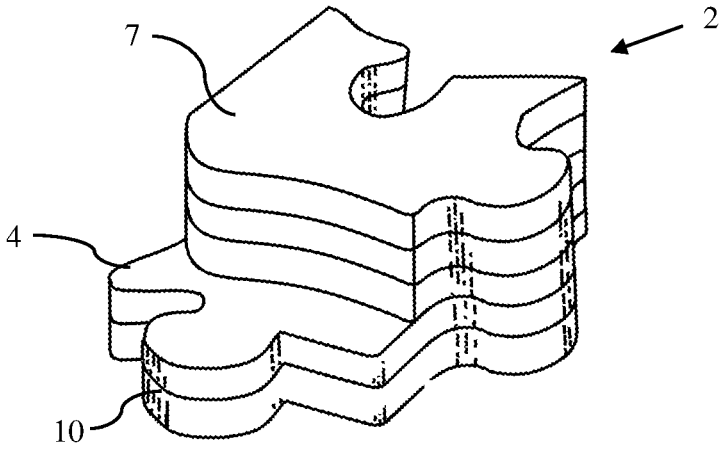
FIG. 12 is an isometric view of a multilevel jigsaw puzzle piece having one change in tier elevation and two visible tiers, in an embodiment of the invention.

Other embodiments of multiple tier puzzle piece 2 possess one change in elevation, as seen in FIG. 12, where the elevation difference is multiple tiers. In the figure, the piece is formed of base tier 3 and a first elevated tier 4 having the same area as base tier 3, i.e. the base tier and first elevated tier are the same size and shape. Second elevated tier 5, and third elevated tier 6, and fourth elevated tier 7 are smaller in area than first elevated tier 4, resulting in a visible section of first elevated tier 4 and a visible section of fourth elevated tier 7. This also results in a change in elevation from the first elevated tier to the fourth elevated tier, or a three-tier elevation change.

Thus, the puzzle piece types include flat or single-level pieces, bi-level pieces having two different elevations, tri-level pieces having three different elevations and quad-level pieces having four different elevations. Subsets of these puzzle pieces can include two changes in tier elevation from a first tier elevation to a second tier elevation and back to the first tier elevation.

Example 4

Figure 13:
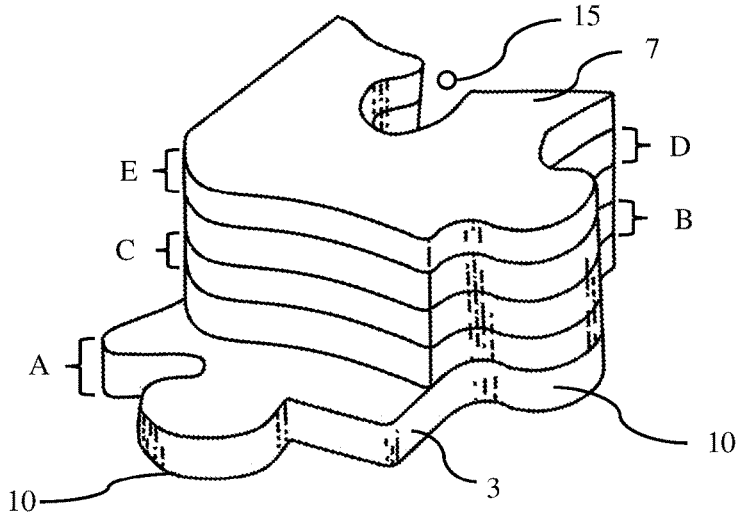
FIG. 13 is an isometric view of a multilevel jigsaw puzzle piece in an embodiment of the invention showing the tiers having different thicknesses.

The multiple level puzzle has a maximum of either 3 tiers, 4 tiers, or 5 tiers, as provided for in the previous Examples. The puzzle pieces forming the puzzle have one or more tiers, and optionally include more than two tiers per puzzle piece. In certain embodiments, the base tier has a first thickness A and the elevated tiers have a thickness which differs from first thickness A, as seen in FIG. 13. As seen in the figure, first elevated tier has a thickness B, second elevated tier has a thickness C, third elevated tier has a thickness D, and fourth elevated tier has a thickness E. In specific embodiments, the base tier has a thickness of 1.6 mm or 1.9 mm. The elevated tiers, i.e. first elevated tier 4, second elevated tier 5, third elevated tier 6, and fourth elevated tier 7, have a minimum thickness of 1.2 mm Optionally, thicknesses B through E have the same thickness. In a nonlimiting example, thicknesses B through E are all 1.2 mm or about 1.2 mm, and are the same thickness. Further, the puzzle piece average surface area varies, but has an average surface area of at least 1.0 sq·in.

Example 5

Figure 14:
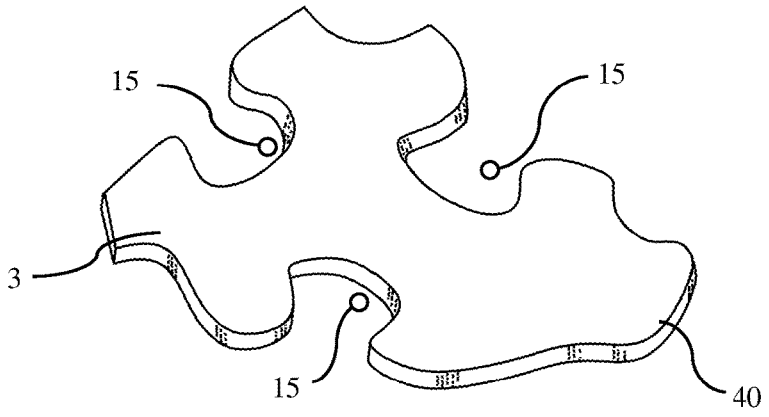
FIG. 14 is an isometric view of a jigsaw puzzle piece with three irregular edges and three holes.
Figure 17:
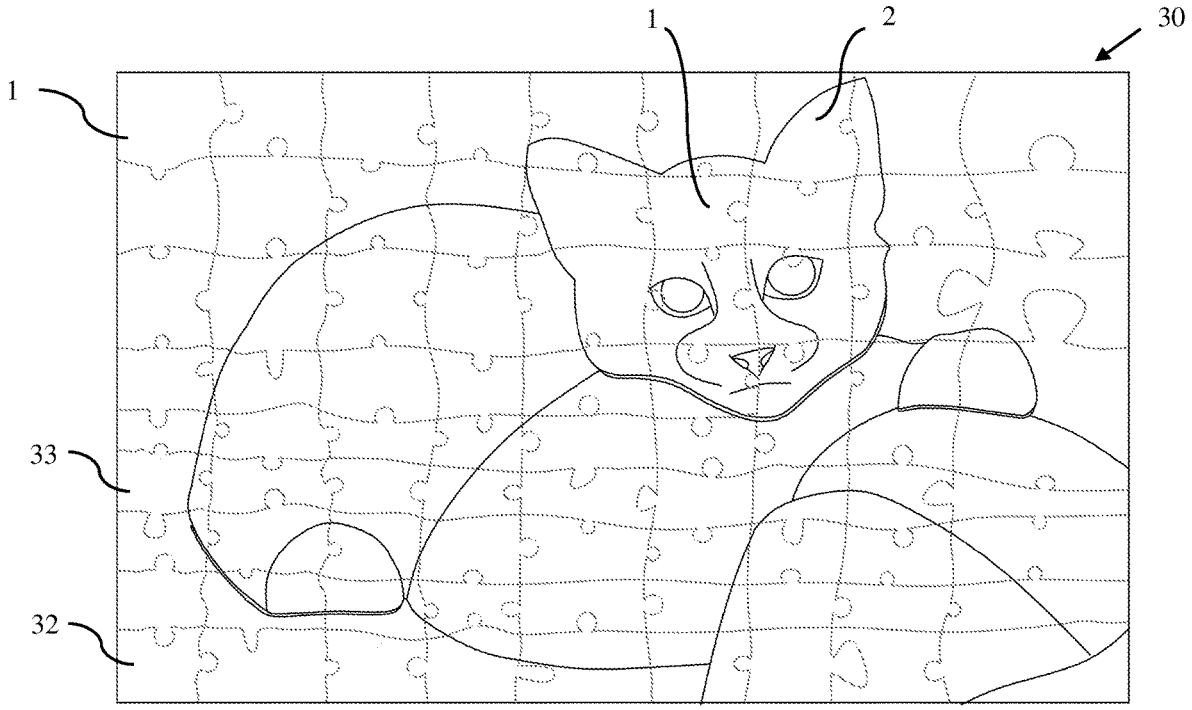
FIG. 17 is a top-down view of a multilevel jigsaw puzzle in an embodiment of the invention. In the disclosed embodiment, the puzzle has a straight-edged border.

The multiple level puzzle has a maximum of either 3 tiers, 4 tiers, or 5 tiers, as provided for in the previous Examples. The puzzle pieces, when viewed by the major side elements and ignoring knobs and holes, approximate geometric shapes. For example, the puzzle pieces can approximate a triangle, as seen in FIG. 14. In the Figure, the puzzle piece approximates a right-angled triangle when holes 15 are ignored. The puzzle pieces can also approximate quadrilaterals, pentagons, hexagons, or heptagons. However, in most instances the plurality of puzzle pieces approximate an irregular rectangle. Irregular edges are not defined as holes or knobs if they do not interconnect. In the figure, irregular edge 40 is complementary by not interlocking with an adjacent puzzle piece. In other embodiments, corner puzzle piece 32 has a knob or hole on two sides as seen in FIG. 17. Edge or border puzzle piece 33 has a knob or hole on three sides as seen in FIG. 17.

Example 6

The multiple level puzzle has a maximum of either 3 tiers, 4 tiers, or 5 tiers, as provided for in the previous Examples. The puzzle pieces of the multiple level jigsaw puzzle have a varied design, based on the desired complexity of the puzzle. The puzzle pieces can be formed of six knob and hole variations; knob-hole-knob-hole, knob-knob-hole-hole, knob-knob-knob-hole, hole-hole-hole-knob, knob-knob-knob-knob, hole-hole-hole-hole. The composition of each variation alters the complexity of assembly, with puzzles containing more similarly constructed pieces increasing the complexity. For example, puzzles with a high composition of knob-hole-knob-hole pieces increase assembly difficulty, as the pieces cannot be distinguished by unique knob-hole combinations. To increase the ease of assembly, the puzzle piece composition is made of about an equal number of the six knob and hole combination.

Example 7

Figure 15:
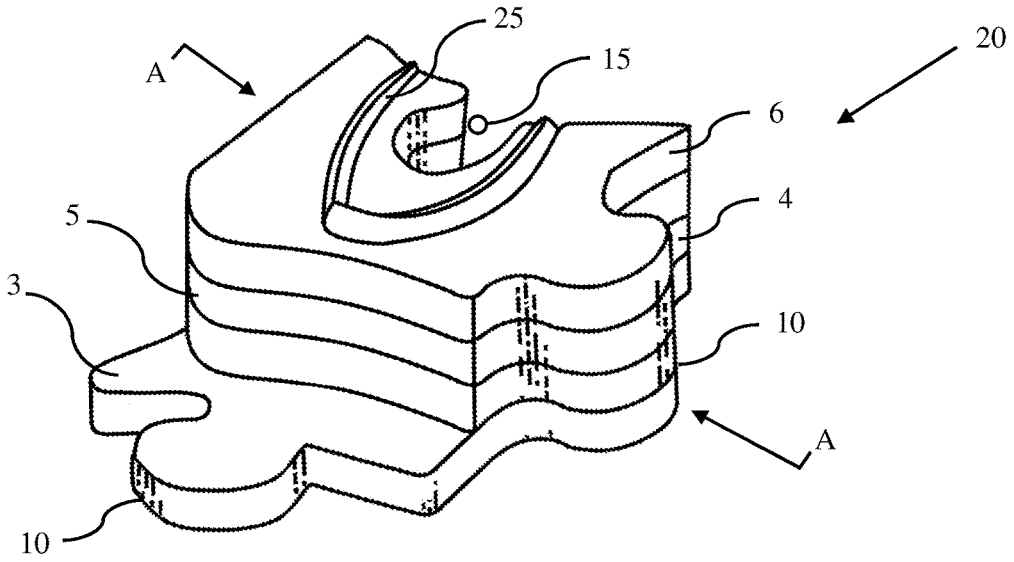
FIG. 15 is an isometric view of a multilevel jigsaw puzzle piece with a contour textured surface in an embodiment of the invention.

The multiple level jigsaw puzzle is formed of a plurality of contour textured multilevel puzzle pieces and contour textured single level puzzle pieces, similar to the multilevel puzzle pieces of Examples 1 and 2. The puzzle pieces include contour textured puzzle piece 20, formed as single level puzzle pieces or multilevel puzzle pieces. As in Example 1, the contour textured single level puzzle piece can be at any elevation. As such, the contour textured single level puzzle piece can be a base level or a single elevated tier, formed of a base tier 3 and at least one elevated tier having the same area as the base tier. The multilevel puzzle piece has two or more changes in elevation, as seen in FIG. 15. The multilevel puzzle piece includes a base level and at least one elevated tier, as discussed in Example 1. For example, the contour textured multilevel puzzle piece can possess a single change in elevation, where the elevation difference is a single tier. In other variations of the contour textured multilevel puzzle piece, the puzzle piece has a change in elevation covering multiple tiers, as seen in FIG. 15. In other variations of the invention, the puzzle piece includes two drops in elevation, or puzzle pieces which include two changes in elevation from a first elevation to a second elevation and back to the first elevation.

Figure 16:
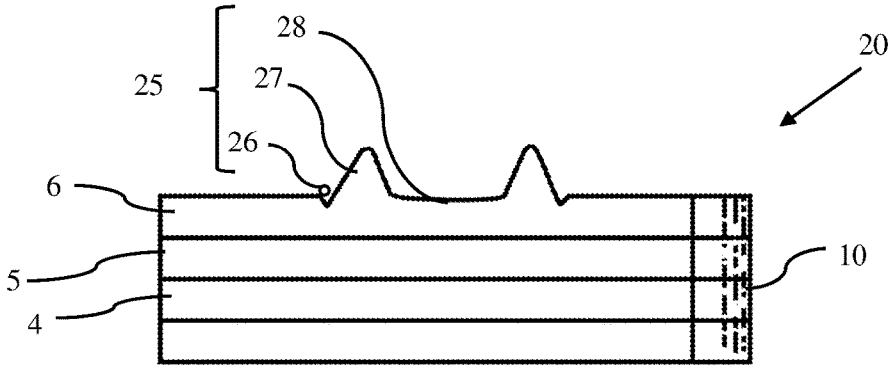
FIG. 16 is a cross sectional view of FIG. 15 at location A-A, showing the multiple contour textured surfaces.

The top-most tier of the contour textured puzzle piece 20 has textured face 28, such as an ear seen in FIG. 15. The textured face is formed from contoured relief 25. Contoured relief 25 includes contour indent 26, contour projection 27, or a combination of the indent and projection, as seen in FIG. 16. Assembly of the multiple level puzzle pieces proceeds similarly to Examples 1 and 2, with the subject image, and optionally background, having a gentle relief mimicking the imagery of the puzzle subject.

Example 8

Contour textured puzzle piece 20 is formed of puzzle pieces as disclosed in the previous Examples. The puzzle has at least base tier 3, having a thickness of 1.6 mm. For pieces formed of elevated tiers, i.e. first elevated tier 4, second elevated tier 5, third elevated tier 6, and fourth elevated tier 7, the elevated tiers have a minimum thickness of 1.2 mm. Embodiments of this example have a contoured relief 25 which does not extend beyond the thickness of the tier, i.e. the relief does not exceed 1.2 mm. The puzzle pieces assemble to form edged puzzle 30 having a raised relief image, or jigsaw edged puzzle 31 having a relief image.

Example 9

The multiple level puzzle has a maximum of either 3 tiers, 4 tiers, or 5 tiers, as provided for in the previous Examples. The puzzle pieces include knob 10 hole 15 along the irregular edges of the piece, which interlock and are complementary to the knob and hole on an adjacent puzzle piece. Straight edged puzzle 30 has edges of the puzzle border which are straight, regardless of the tier, i.e. the base tier and any elevated tier contacting the edge of the puzzle have a straight edge, as seen in FIG. 17. The subject image has a contoured edge, mimicking the subject image or a portion thereof. In some embodiments, the image possesses various levels, such as a second level for the subject rear body, a third level for the subject front body, and a fourth level for the subject head.

Figure 18:
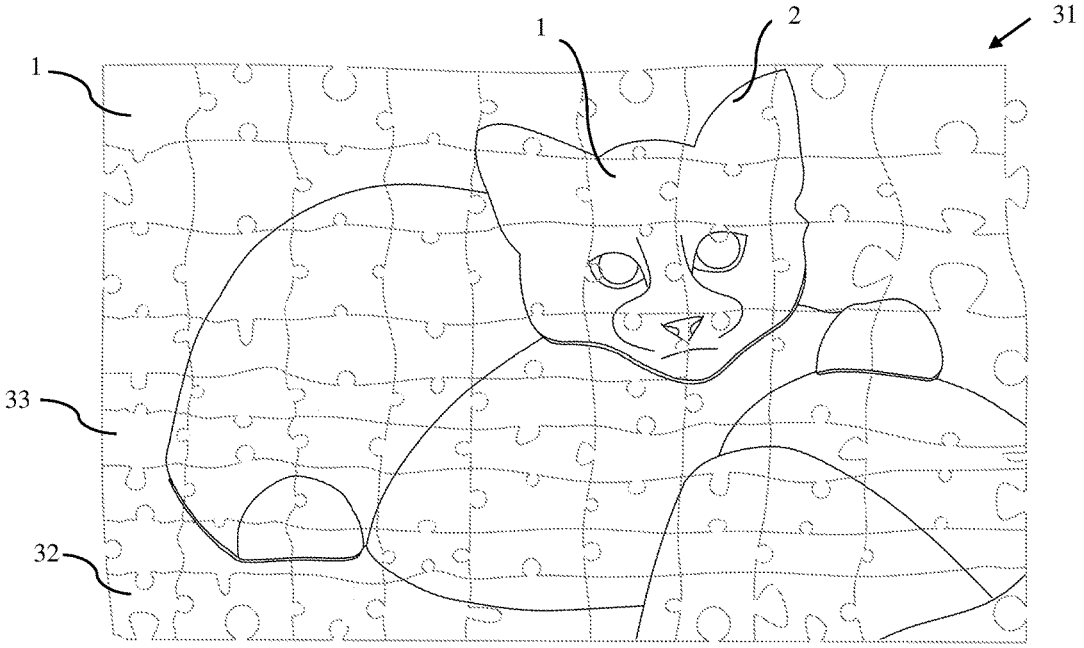
FIG. 18 is a top-down view of a multilevel jigsaw puzzle in an embodiment of the invention. In the disclosed embodiment, the puzzle has a jigsaw-edged border.

Jigsaw edged puzzle 31, seen in FIG. 18, is formed of a plurality of multilevel puzzle pieces and single level puzzle pieces, as disclosed in Example 1. Jigsaw edged puzzle 31 has edges of the puzzle border which mimic the jigsaw edges, i.e. the puzzle edges have puzzle pieces including knob 10 and hole 15 along the puzzle edges. The knob or hole on the border edge does not interlock with an adjacent piece and can be simply an irregular edge. The edges include base tier and any elevated tier contacting the edge of the puzzle. The subject image has a contoured edge, mimicking the subject image or a portion thereof. In some embodiments, the image possesses various levels, such as a second level for the subject rear body, a third level for the subject front body, and a fourth level for the subject head.

Example 10

The puzzle pieces of the multiple level jigsaw puzzle, described in the previous Examples, have three tiers; a base tier, a first elevated tier, and a second elevated tier. In this embodiment, the base tier has a thickness of 1.9 mm, the first elevated tier has a thickness of 1.9 mm, and the second elevated tier has a thickness of 1.9 mm. The breakdown of percentages of puzzle pieces are a minimum of 40% of the puzzle pieces have only a base tier, i.e. tier 1; a minimum of 20% of the puzzle pieces have a base tier and first elevated tier, i.e. tier 2; and a minimum of 20% of the puzzle pieces have all three tiers, or tier 3.

Example 11

The puzzle pieces of the multiple level jigsaw puzzle, described in the previous Examples, have four tiers; a base tier, a first elevated tier, a second elevated tier, and a third elevated tier. In this embodiment, the base tier has a thickness of 1.6 mm, the first elevated tier has a thickness of 1.6 mm, the second elevated tier has a thickness of 1.6 mm, and the third elevated tier has a thickness of 1.6 mm. The breakdown of percentages of puzzle pieces are a minimum of 35% of the puzzle pieces have only a base tier, i.e. tier 1; a minimum of 15% of the puzzle pieces have a base tier and first elevated tier, i.e. tier 2; a minimum of 15% of the puzzle pieces have three tiers, or tier 3; and a minimum of 15% of the puzzle pieces have all four tiers, or tier 4.

Example 12

The puzzle pieces of the multiple level jigsaw puzzle, described in the previous Examples, have five tiers; a base tier, a first elevated tier, a second elevated tier, a third elevated tie, and a fourth elevated tier. In this embodiment, the base tier has a thickness of 1.6 mm, the first elevated tier has a thickness of 1.2 mm, the second elevated tier has a thickness of 1.2 mm, the third elevated tier has a thickness of 1.2 mm, and the fourth elevated tier has a thickness of 1.2 mm. The breakdown of percentages of puzzle pieces are a minimum of 30% of the puzzle pieces have only a base tier, i.e. tier 1; a minimum of 15% of the puzzle pieces have a base tier and first elevated tier, i.e. tier 2; a minimum of 15% of the puzzle pieces have three tiers, or tier 3; a minimum of 15% of the puzzle pieces have four tiers, or tier 4; and a minimum of 5% of the puzzle pieces have all five tiers, or tier 5.

Example 13

The puzzle pieces of the multiple level jigsaw puzzle, described in any one of the previous Examples, can be classified based on the highest number of visible tiers disposed on the puzzle piece. For example, the single level puzzle pieces can be classified as visible tier 1, 2, or 3, for variations having up to 3 tiers; visible tier 1, 2, 3, or 4, for variations having up to 4 tiers; or visible tier 1, 2, 3, 4, or 5, for variations having up to 5 tiers; depending on the number of elevated tiers. Multiple level pieces can also be classified by their visible tiers. For example, a multiple level piece with a tier 2 and a tier 4, or 2+4 puzzle piece, is classified both as a visible tier 2 and a visible tier 4. In such classification, to meet the enhanced image and assembly strategy goals of the invention, the puzzle pieces for any of Examples 1 through 5, 7, or 8, are formed such that at least 40% of the puzzle pieces contain a visible tier 1 classification, at least 20% fall into a visible tier 2 classification, and at least 20% fall into a visible tier 3 classification, for 3 tier variations. For 4 tier variations, at least 35% of the puzzle pieces contain a visible tier 1 classification, at least 15% fall into a visible tier 2 classification, at least 15% fall into a visible tier 3 classification, and at least 15% fall into a visible tier 4 classification. For 5 tier variations, at least 30% of the puzzle pieces contain a visible tier 1 classification, at least 20% fall into a visible tier 2 classification, at least 15% fall into a visible tier 3 classification, at least 10% fall into a visible tier 4 classification, and at least 5% fall into a visible tier 5 classification.

Example 14

The puzzle pieces of the multiple level jigsaw puzzle, described in any one of the previous Examples, can be classified based on the type of puzzle piece, or piece type. The specific piece types include flat, bi-level, and tri-level. In such classification, to meet the enhanced image and assembly strategy goals of the invention, the puzzle pieces for any of Examples 1 through 4 are formed such that at least 20% of the puzzle pieces fall into a flat classification, meaning the puzzle pieces do not change elevation. At least 35% of the puzzle pieces fall into a bi-level classification, meaning there are two separate levels on the puzzle piece. At least 5% of the puzzle pieces fall into a tri-level classification, or the puzzle piece contains three separate levels on the piece.

Example 15

The puzzle pieces of the multiple level jigsaw puzzle, described in any one of the previous Examples, can be classified based on the change in tier elevation disposed on the puzzle piece. The specific changes in tier elevation include one, two, and/or three. In such classification, to meet the enhanced image and assembly strategy goals of the invention, the puzzle pieces for any of Examples 1 through 4 are formed such that at least 25% of the puzzle pieces have one change in tier elevation, such as from the base tier to tier 2, from tier 2 to tier 3, i.e. 2+3, etc. At least 12% of the puzzle pieces have two changes in tier elevation, such as from the base tier to tier 3, i.e. 1+3, from tier 2 to tier 4, i.e. 2+4 piece, or a multiple change in elevation such as from the base tier to tier 3 and to tier 2, i.e. 1+2+3 piece. At least 8% of the puzzle pieces have a three-tier changes in tier elevation, such as from the base tier to tier 4, or 1+4 piece, or a multiple change in elevation such as from the base tier to tier 4 and to tier 2 or 3, i.e. a 1+3+4 piece or 1+2+4 piece. The remaining pieces do not have a change in elevation, either the base tier or a flat elevated tier. At least 35% of the puzzle pieces are puzzle pieces having no change in tier elevation.

Example 16

Figure 19:
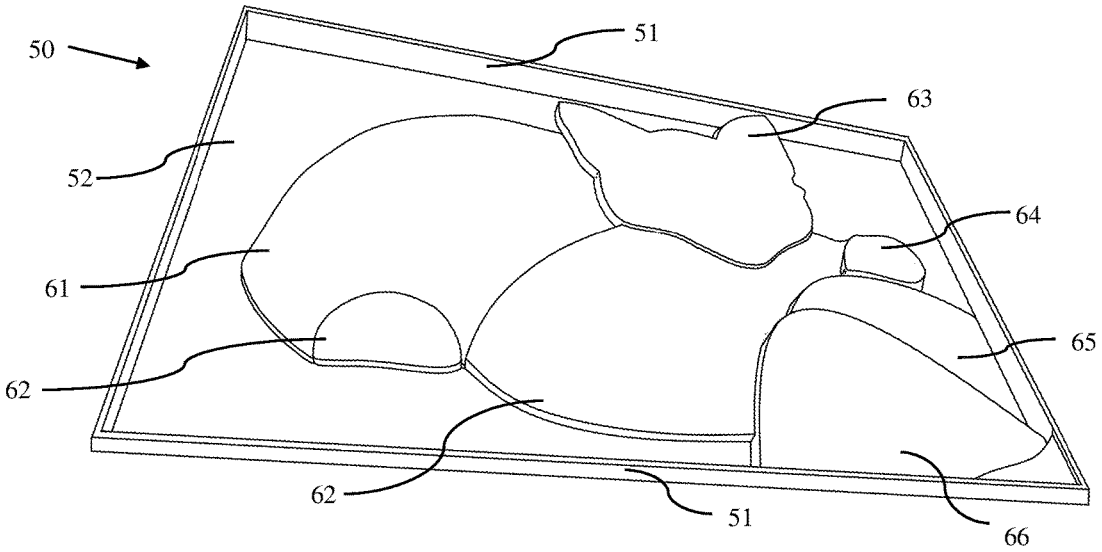
FIG. 19 is an isometric view of a multilevel jigsaw puzzle frame with numerous levels and an exterior rail.

In this variation, the multiple level jigsaw puzzle is comprised of tiered frame 50 and single tier puzzle pieces 1. Tiered frame 50 is formed of base plate 51, side rails 52, and one or more tiers, as seen in FIG. 19. In the illustrative example, tiered frame 50 includes first elevated frame tier 61, second elevated frame tier 62, third elevated frame tier 63, fourth elevated frame tier 64, fifth elevated frame tier 65, and sixth elevated frame tier 66. However, it is within the skill of an ordinary artisan to modify the number of tiers to accomplish the desired effect.

Figure 20:
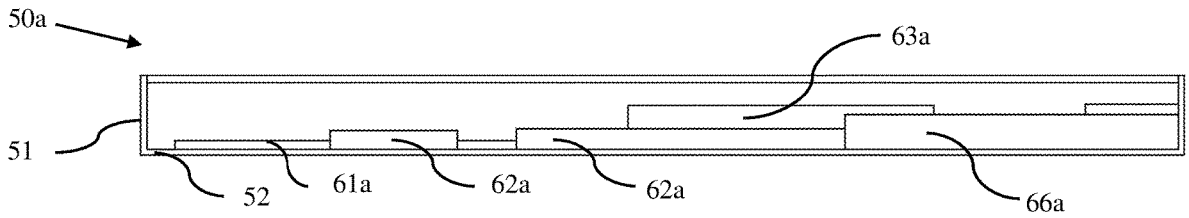
FIG. 20 is a cross sectional view of a multilevel jigsaw puzzle frame in an embodiment of the invention.

In this variation, each tier is a flat elevation, as seen in FIG. 20. Accordingly, in the illustrative example, each tier is a distinct flat elevation forming first flat elevated frame tier 61*a*, second flat elevated frame tier 62*a*, third flat elevated frame tier 63*a*, fourth flat elevated frame tier 64*a*, fifth flat elevated frame tier 65*a*, and sixth flat elevated frame tier 66*a*. Flat tiered frame 50*a* can be formed of metal, wood, plastic, paperboard, or cardboard. In some variations, the tiered frame is formed of wood sections that are formed by computer numerical control (CNC) grinding, lathing, router, rotary, or drill press. Alternatively, the tiered frame is formed of plastic that is vacuum formed, slide molded, or injection molded. In alternative variations, flat tiered frame 50*a* is formed of base plate 51, and one or more tiers, i.e. lacks side rails 52.

Figure 21:
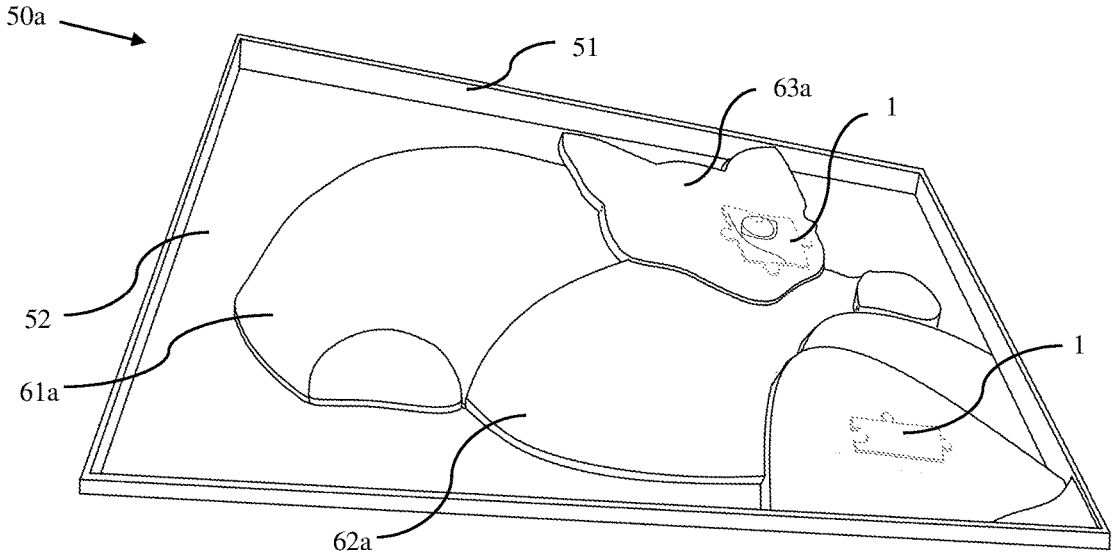
FIG. 21 is an isometric view of a multilevel jigsaw puzzle frame in an embodiment of the invention.

Single tier puzzle pieces 1 are assembled on each tier, thereby forming a multiple level puzzle, as seen in FIG. 21.

Example 17

Figure 22:
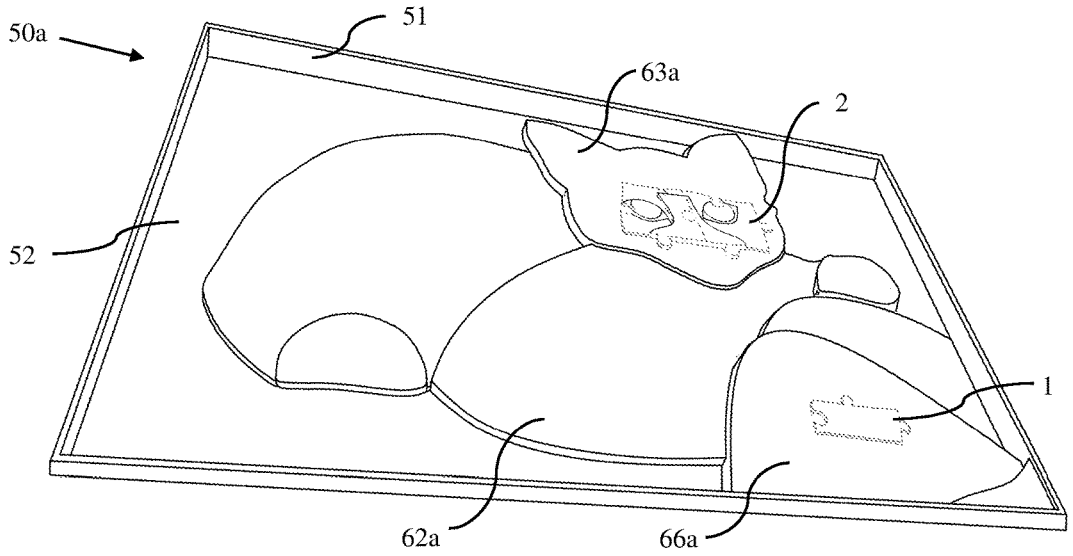
FIG. 22 is an isometric view of a multilevel jigsaw puzzle frame in an embodiment of the invention showing use of multiple level puzzle pieces.

The multiple level jigsaw puzzle, includes flat tiered frame 50*a*, described in the previous Example. In this variation, the multiple level jigsaw puzzle is comprised of the tiered frame and multiple tier puzzle pieces 2 or a combination of single tier puzzle pieces 1 and multiple tier puzzle pieces 2, as seen in FIG. 22.

Each tier is assembled independently using multiple tier puzzle pieces 2 or a combination of single tier puzzle pieces 1 and multiple tier puzzle pieces 2.

Example 18

Figure 23:
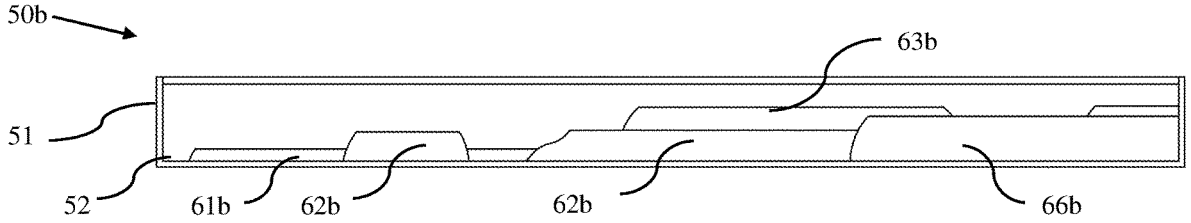
FIG. 23 is a cross sectional view of a multilevel jigsaw puzzle frame in an embodiment of the invention showing contoured levels.

In this variation, the multiple level jigsaw puzzle is comprised of contoured tiered frame 50*b* and the puzzle pieces of the multiple level jigsaw puzzle, described in the previous Examples. However, while single tier puzzle pieces 1, multiple tier puzzle pieces 2 or a combination of single tier puzzle pieces 1 and multiple tier puzzle pieces 2 can be used, it is preferred to use contour textured puzzle piece 20. Contoured tiered frame 50*b* is formed of base plate 51, side rails 52, and one or more partially contoured tiers, as seen in FIG. 23. In the illustrative example, tiered frame 50*b* includes first contoured elevated frame tier 61*b*, second contoured elevated frame tier 62*b*, third contoured elevated frame tier 63*b*, fourth contoured elevated frame tier 64*b*, fifth contoured elevated frame tier 65*b*, and sixth contoured elevated frame tier 66*b*. As with the prior examples, it is within the skill of an ordinary artisan to modify the number of tiers to accomplish the desired three-dimensional effect.

Contoured tiered frame 50*b* can be formed of metal, wood, plastic, paperboard, or cardboard. In some variations, the tiered frame is formed of wood sections that are formed by computer numerical control (CNC) grinding, lathing, router, rotary, or drill press. Alternatively, the tiered frame is formed of plastic that is vacuum formed, slide molded, or injection molded. In alternative variations, contoured tiered frame 50*b* is formed of base plate 51, and one or more tiers, i.e. lacks side rails 52.

Figure 24:
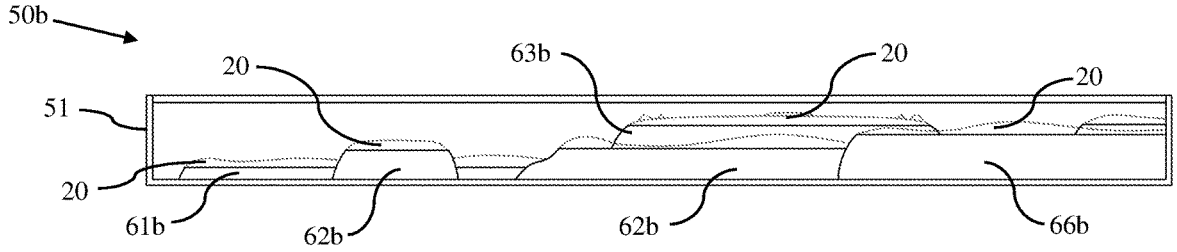
FIG. 24 is a cross sectional view of a multilevel jigsaw puzzle frame in an embodiment of the invention showing contoured levels with contoured puzzle pieces.

As seen in the cross-sectional image of FIG. 23, each contoured level does not fully complete the shape of the level. The tier of contoured tiered frame 50*b* is designed to engage contour textured puzzle pieces 20 of the respective level to complete the relief or contour of the level, as seen in FIG. 24.

The disclosures of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall there between. Now that the invention has been described, what is claimed is:

The invention claimed is:

1. A multiple level jigsaw puzzle, wherein the multiple level puzzle comprises a plurality of puzzle pieces further comprising:

a plurality of single tier puzzle pieces, wherein the single tier puzzle pieces further comprise:

at least a base tier, wherein the base tier has a top face, a bottom face, and at least three distinct irregular edges disposed between the top face and the bottom face;

at least one base knob or base hole disposed on at least one irregular edge of the at least a base tier, wherein the base knob or base hole is complementary to and interlocking with an adjacent puzzle piece;

at least one multiple tier puzzle piece, wherein the multiple tier puzzle piece further comprises:

a base tier, wherein the base tier has a top face, a bottom face, and at least three distinct irregular edges disposed between the top face and the bottom face;

a first elevated tier disposed on the top face of the base tier, wherein the first elevated tier has a first tier top face and a first tier bottom face, and is at a first height;

at least a second elevated tier disposed on the top face of the first elevated tier, wherein the second elevated tier has a second tier top face, a second tier bottom face, at least one irregular edge disposed between the second tier top face and the second tier bottom face and correlating with one of the at least three irregular edges disposed on the base tier;

wherein the second elevated tier is at a second height; and at least one elevated knob or elevated hole disposed on at least one irregular edge of the at least a second elevated tier and aligned with the at least one base knob or base hole, wherein the elevated knob or elevated hole is complementary to and interlocking with an adjacent puzzle piece.

2. The multiple level jigsaw puzzle of claim 1, wherein the base tier of the plurality of single tier puzzle pieces has a thickness of about 1.6 mm to about 1.9 mm.

3. The multiple level jigsaw puzzle of claim 1, wherein the base tier of the plurality of multiple tier puzzle pieces has a thickness of about 1.6 mm to about 1.9 mm.

4. The multiple level jigsaw puzzle of claim 3, wherein the at least one elevated tier has a thickness of about 1.2 mm to about 1.9 mm.

5. The multiple level jigsaw puzzle of claim 1, wherein the plurality of puzzle pieces are cardboard, wood, paperboard, chipboard, or plastic.

6. The multiple level jigsaw puzzle of claim 1, wherein the plurality of puzzle pieces further comprises at least one multiple tier puzzle piece having 4 tiers or 5 tiers.

7. The multiple level jigsaw puzzle of claim 1, wherein the plurality of puzzle pieces has an average planar or surface area of at least 1.0 square inches.

8. The multiple level jigsaw puzzle of claim 1, wherein the plurality of single tier puzzle pieces and the at least one multiple tier puzzle piece are comprised of the following:

at least 40% of the pieces have a maximum elevated tier of a base tier or visible tier 1;

at least 20% of the pieces have a maximum elevated tier of a first elevated tier or visible tier 2; and at least 20% of the pieces have a maximum elevated tier of a second elevated tier or visible tier 3.

9. The multiple level jigsaw puzzle of claim 1, wherein the plurality of single tier puzzle pieces and the at least one multiple tier puzzle piece are comprised of the following:

at least 35% of the pieces have a maximum elevated tier of a base tier or visible tier 1;

at least 15% of the pieces have a maximum elevated tier of a first elevated tier or visible tier 2;

at least 15% of the pieces have a maximum elevated tier of a second elevated tier or visible tier 3; and at least 15% of the pieces have a maximum elevated tier of a third elevated tier or visible tier 4.

10. The multiple level jigsaw puzzle of claim 1, wherein the plurality of single tier puzzle pieces and the at least one multiple tier puzzle piece are comprised of the following:

at least 30% of the pieces have a maximum elevated tier of a base tier or visible tier 1;

at least 15% of the pieces have a maximum elevated tier of a first elevated tier or visible tier 2;

at least 15% of the pieces have a maximum elevated tier of a second elevated tier or visible tier 3;

at least 10% of the pieces have a maximum elevated tier of a third elevated tier or visible tier 4; and at least 5% of the pieces have a maximum elevated tier of a fourth elevated tier or visible tier 5.

11. The multiple level jigsaw puzzle of claim 1, further comprising at least one five tier puzzle piece;

wherein the at least one five tier puzzle piece comprise the base tier, the first elevated tier disposed on the top face of the base tier, a second elevated tier disposed on the first elevated tier, a third elevated tier disposed on the second elevated tier, and a fourth elevated tier disposed on the third elevated tier;

wherein the at least one five level puzzle piece comprises at least 15% of the pieces; and wherein the fourth elevated tier is a visible tier, at least one of the base tier, first elevated tier, second elevated tier, or third elevated tier is partially visible under a fourth visible tier.

12. The multiple level jigsaw puzzle of claim 1, wherein the plurality of single tier puzzle pieces comprise at least 20% of the pieces;

wherein the at least one multiple tier puzzle piece are bi-tier pieces, and the bi-tier pieces comprise at least 35% of the pieces;

wherein the at least one multiple level puzzle piece are tri-level pieces, and the tri-level pieces comprise at least 5% of the pieces.

13. The multiple level jigsaw puzzle of claim 1, wherein the plurality of single tier puzzle pieces further comprise at least 35% of the pieces.

14. The multiple level jigsaw puzzle of claim 1, wherein the at least one multiple tier puzzle piece is a plurality of puzzle pieces and the at least one multiple tier puzzle pieces comprise the following:

at least 25% of the pieces have one change in tier elevation;

at least 12% of the pieces have two changes in tier elevation; and at least 8% of the pieces have three changes in tier elevation.

15. The multiple level jigsaw puzzle of claim 1, wherein the top face of at least one of the plurality of single tier puzzle pieces has a contoured texture, wherein the contoured texture mimics a subject object.

16. The multiple level jigsaw puzzle of claim 1, wherein the top face of at least one multiple tier puzzle piece has a contoured texture, wherein the contoured texture mimics a subject object.

17. The multiple level jigsaw puzzle of claim 1, wherein the puzzle has a straight border, jigsaw border, or a contoured border.

18. The multiple level jigsaw puzzle of claim 1, further comprising:

at least one first elevated tier puzzle piece, wherein the first elevated tier puzzle piece further comprises:

a base tier, wherein the base tier has a top face, a bottom face, and at least three irregular edges disposed between the top face and the bottom face; and a first elevated tier disposed on the top face of the base tier, wherein the first elevated tier has a first tier top face and a first tier bottom face, and is at a first height.

* * * * *